US007944281B2

(12) United States Patent
Yu et al.

(10) Patent No.: US 7,944,281 B2
(45) Date of Patent: May 17, 2011

(54) CONSTANT REFERENCE CELL CURRENT GENERATOR FOR NON-VOLATILE MEMORIES

(75) Inventors: Da-Guang Yu, Fremont, CA (US); Vithal Rao, San Jose, CA (US)

(73) Assignee: MoSys, Inc., Santa Clara, CA (US)

( * ) Notice: Subject to any disclaimer, the term of this patent is extended or adjusted under 35 U.S.C. 154(b) by 60 days.

(21) Appl. No.: 12/334,338

(22) Filed: Dec. 12, 2008

(65) Prior Publication Data

US 2010/0148855 A1 Jun. 17, 2010

(51) Int. Cl.
*G05F 1/12* (2006.01)

(52) U.S. Cl. ..... 327/538; 323/312

(58) Field of Classification Search ..... None
See application file for complete search history.

(56) References Cited

U.S. PATENT DOCUMENTS 4,645,948 A * 2/1987 Morris et al. ..... 327/538
5,510,750 A * 4/1996 Cho ..... 327/546
5,801,523 A * 9/1998 Bynum ..... 323/315
5,864,230 A * 1/1999 Dondale ..... 323/312
6,184,724 B1 * 2/2001 Lin ..... 327/80
6,335,893 B1 * 1/2002 Tanaka et al. ..... 365/226
6,433,624 B1 * 8/2002 Grossnickle et al. ..... 327/543
6,646,496 B2 * 11/2003 Watanabe ..... 327/541
6,717,878 B2 * 4/2004 Hagura et al. ..... 365/211
6,720,822 B2 * 4/2004 Torrisi et al. ..... 327/536
7,272,053 B2 * 9/2007 Choy ..... 365/185.29
7,595,685 B1 * 9/2009 Sakurai ..... 327/538

* cited by examiner

*Primary Examiner* — Thomas J Hiltunen
(74) *Attorney, Agent, or Firm* — E. Eric Hoffman; Bever, Hoffman & Harms, LLP

(57) ABSTRACT

A reference current generation circuit generates a first branch current that varies by a first percentage in response to variations in a first supply voltage and variations in transistor threshold voltage. The first branch current is mirrored to create a corresponding second branch current. A first portion (sub-current) of the second branch current is supplied through a first transistor, which exhibits the transistor threshold voltage wherein the first sub-current varies by a second percentage in response to the variations in the first supply voltage and variations in transistor threshold voltage, wherein the second percentage is greater than the first percentage. A second portion (sub-current) of the second branch current is supplied through a second transistor. The second portion of the second branch current is mirrored to create a reference current ($I_{REF}$).

21 Claims, 4 Drawing Sheets

200

| | VOLTAGE VARIATIONS | | PROCESS VARIATIONS | | | | | |
|---|---|---|---|---|---|---|---|---|
| | $V_{DD}$ | $V_{NEG}$ | R1 | $V_{TN}$ | $V_{TP}$ | $I_1/I_2$ | $I_{2A}$ | $I_{2B}/I_{REF}$ |
| $I_{MIN}$ | 1.08 V | -2.25 V | HIGH (SLOW) | HIGH (SLOW) | HIGH (SLOW) | 100 | 50 | 50 |
| $I_{TYP}$ | 1.20 V | -2.50 V | INT | INT | INT | 180 | 110 | 70 |
| $I_{MAX}$ | 1.32 V | -2.75 V | LOW (FAST) | LOW (FAST) | LOW (FAST) | 265 | 172 | 93 |

FIG. 2

CONSTANT REFERENCE CELL CURRENT GENERATOR FOR NON-VOLATILE MEMORIES

FIELD OF THE INVENTION

The present invention relates to a semiconductor circuit that generates a constant reference current. More specifically, the present invention relates to a circuit that provides a constant reference current to a semiconductor memory sensing circuit, wherein the constant reference current is compared with a current through a nonvolatile memory cell (such as a flash cell or an EEPROM cell).

RELATED ART

A conventional nonvolatile memory cell, such as a Flash or EEPROM cell, is read by applying predetermined read control voltages to the cell. The read control voltages are selected such that a read current having a first magnitude will flow through a programmed memory cell, and a read current having a second magnitude (significantly different than the first magnitude) will flow through an erased memory cell. The read current is provided to a memory sensing circuit. A current reference circuit generates a reference current, which is also provided to the memory sensing circuit. The reference current is selected to have a magnitude between the first magnitude and the second magnitude. The memory sensing circuit compares the read current with the reference current to determine the status of the non-volatile memory cell.

Although it is desirable for the reference current to have a constant value, the reference current will typically vary in response to process variations (e.g., variations in resistances and in the threshold voltages of NMOS and PMOS transistors), variations in temperature, and variations in the supply voltages used to generate the reference current. The reference current may also vary in response to voltage ripples introduced by a noisy charge pump. If the variations in the reference current become too large, the memory sensing circuit may provide erroneous read results.

It would therefore be desirable to have an improved reference current generation circuit that overcomes the above described deficiencies of the prior art.

SUMMARY

Accordingly, the present invention provides an improved reference current generation circuit that includes a first current branch coupled between a first voltage supply terminal and a second voltage supply terminal, wherein a first branch current flows through the first current branch. In one embodiment, the first current branch includes one or more circuit elements having a positive temperature coefficient and one or more circuit elements having a negative temperature coefficient, such that the first branch current is compensated for variations in temperature. In one embodiment, the first current branch includes a PMOS transistor, an NMOS transistor and a resistor.

A current mirror circuit mirrors the first branch current to a second current branch, such that a second branch current, which is representative of the first branch current, flows in the second current branch. In a particular embodiment, the second branch current is equal to the first branch current.

The second branch current flows from a second branch node to the second voltage supply terminal. The second branch current is supplied from a first sub-branch and a second sub-branch, each of which is commonly connected between the first voltage supply terminal and the second branch node. The first sub-branch includes a PMOS transistor that is biased to supply a first branch sub-current that varies in response to variations in the PMOS transistor threshold voltage ($V_{TP}$) and variations in the first supply voltage provided by the first voltage supply terminal. The second sub-branch may include a PMOS transistor that is connected as a diode.

The first branch sub-current varies in the same manner as the first branch current (and therefore the second branch current) in response to variations in the PMOS transistor threshold voltage $V_{TP}$ and variations in the first supply voltage. For example, when the PMOS transistor threshold voltage $V_{TP}$ increases (decreases), the first branch current and the first branch sub-current both decrease (increase). Similarly, when the first supply voltage increases (decreases), the first branch current and the first branch sub-current both increase (decrease). The net result is that the variations in the first branch current and the first branch sub-current tend to offset one another. As a result, the second branch sub-current flowing through the second sub-branch remains relatively constant in view of variations in the PMOS transistor threshold voltage $V_{TP}$ and variations in the first supply voltage. Stated another way, the second branch sub-current is much more resistant to variations in the PMOS transistor threshold voltage $V_{TP}$ and variations in the first supply voltage than the first branch current. In one embodiment, the second branch sub-current is mirrored to provide a stable reference current.

In a particular embodiment, the first supply voltage is a positive voltage ($V_{DD}$) and the second supply voltage is a negative voltage ($V_{NEG}$), and the PMOS transistor of the first sub-branch is biased by the ground supply voltage. In an alternate embodiment, the PMOS transistor of the first sub-branch is biased by a resistive voltage divider circuit, which is coupled between a constant reference voltage ($V_{REF}$) and the negative supply voltage. As a result, the first branch sub-current varies in the same manner as the first branch current (and therefore the second branch current) in response to variations in the negative supply voltage.

In another embodiment, a current mirror circuit mirrors the second branch sub-current to a third current branch, such that a third branch current, which is representative of the second branch sub-current, flows in the third current branch. In a particular embodiment, the third branch current is equal to the second branch sub-current.

The third branch current flows from the first voltage supply terminal to a third branch node. The third branch current supplies a third sub-branch and a fourth sub-branch, each of which is commonly connected between the third branch node and the second voltage supply terminal. The third sub-branch includes an NMOS transistor that is biased to supply a third branch sub-current that varies in response to variations in the NMOS transistor threshold voltage ($V_{TN}$) and variations in the first supply voltage. The fourth sub-branch may include a NMOS transistor that is connected as a diode.

The third branch sub-current varies in the same manner as the first branch current (and therefore the second branch current and the third branch current) in response to variations in the NMOS transistor threshold voltage $V_{TN}$ and variations in the first supply voltage. For example, when the NMOS transistor threshold voltage $V_{TN}$ increases (decreases), the first, second and third branch currents and the third branch sub-current all decrease (increase). Similarly, when the second supply voltage increases (decreases), the first, second and third branch currents and the third branch sub-current all decrease (increase). The net result is that the variations in the third branch current and the third branch sub-current tend to offset one another. As a result, the fourth branch sub-current flowing through the fourth sub-branch remains relatively constant in view of variations in the NMOS transistor threshold voltage $V_{TN}$ and variations in the first supply voltage. Stated another way, the fourth branch sub-current is much more resistant to variations in the NMOS transistor threshold voltage $V_{TN}$ and variations in the first supply voltage than the first branch current. In one embodiment, the fourth branch sub-current is mirrored to provide a stable reference current.

The present invention will be more fully understood in view of the following description and drawings.

BRIEF DESCRIPTION OF THE DRAWINGS

FIG. 2 is a table that defines the voltage and process conditions that result in minimum, maximum and typical currents within the reference current generation circuit of FIG. 1 in accordance with one embodiment of the present invention.

DETAILED DESCRIPTION

Figure 1:
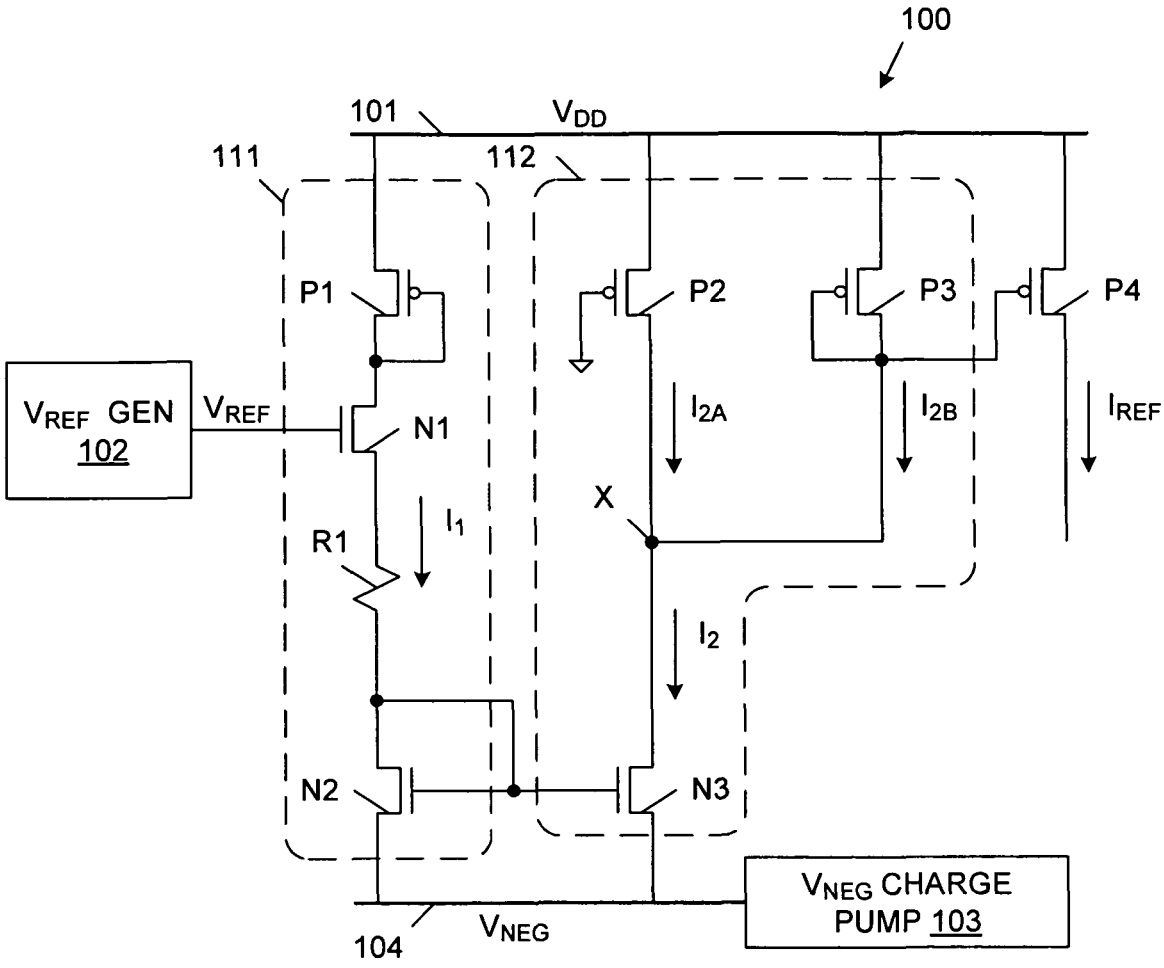
FIG. 1 is a circuit diagram of a reference current generation circuit in accordance with one embodiment of the present invention.

FIG. 1 is a circuit diagram of a reference current generation circuit 100 in accordance with one embodiment of the present invention. Reference current generation circuit 100 includes PMOS transistors P1-P4, NMOS transistors N1-N3, resistor R1, $V_{DD}$ voltage supply rail 101, reference voltage generation circuit 102, negative voltage charge pump 103 and negative voltage supply rail 104. In the described embodiments, circuit 100 is fabricated using a conventional 130 nm CMOS process. The $V_{DD}$ voltage supply rail 101 receives a $V_{DD}$ supply voltage of 1.2 Volts +/−10% (i.e., 1.32 Volts to 1.08 Volts). The reference voltage generation circuit 102 is a bandgap reference circuit that provides a reference voltage $V_{REF}$ of about 1.23 Volts. In one embodiment, the reference voltage $V_{REF}$ has a value in the range of about 1.20 to 1.25 Volts. The negative voltage charge pump 103 provides a negative voltage $V_{NEG}$ of −2.5 Volts +/−10% (i.e., −2.25 Volts to −2.75 Volts) to negative voltage supply rail 104. In other embodiments, one of ordinary skill could fabricate reference current generation circuit 100 with other processes, and may operate circuit 100 in response to other voltages, in view of the teachings of the present specification.

PMOS transistor P1, NMOS transistors N1-N2 and resistor R1 are connected in series between the $V_{DD}$ voltage supply rail 101 and the $V_{NEG}$ supply rail 104, thereby forming a first current branch 111. More specifically, the source of PMOS transistor P1 is coupled to the $V_{DD}$ voltage supply rail 101. The gate and drain of PMOS transistor P1 are commonly connected, such that PMOS transistor P1 operates as diode. The drain of PMOS transistor P1 is also connected to the drain of NMOS transistor N1. The gate of NMOS transistor N1 is coupled to receive the reference voltage $V_{REF}$ from reference voltage generation circuit 102. The source of NMOS transistor N1 is connected to one end of resistor R1, and the drain and gate of NMOS transistor N2 are connected to the other end of resistor R1. The source of NMOS transistor N2 is coupled to the negative voltage supply rail 104.

PMOS transistor P1, NMOS transistors N1-N2 and resistor R1 form the first current branch 111, which carries a first branch current $I_1$. During normal operating conditions (i.e., when the $V_{DD}$, $V_{REF}$ and $V_{NEG}$ voltages have the above specified values), PMOS transistor P1 and NMOS transistors N1-N2 are conductive, such that a positive first branch current $I_1$ flows from the $V_{DD}$ voltage supply rail 101 toward the negative voltage supply rail 104.

Variations in the branch current $I_1$ due to variations in temperature are considerably reduced by two opposing features present in the first current branch. As temperature increases, the absolute values of the threshold voltages of transistors P1, N1 and N2 decrease, thereby tending to increase the first branch current $I_1$. However, as temperature increases, the resistance of resistor R1 increases, thereby tending to decrease the first branch current $I_1$. In accordance with one embodiment, the device sizes of resistor R1 and transistors P1, N1 and N2 are selected such that these two opposing effects compensate for one another, thereby eliminating major variations of the first branch current $I_1$ due to variations in temperature. However, minor variations of the first branch current $I_1$ due to temperature variations will still exist, as the compensation is not perfect. In a particular embodiment, resistor R1 has a resistance of about 300 kΩ, PMOS transistor P1 has a width of about 10 μm and a length of about 2 μm, and NMOS transistors N1-N2 each have a width of about 2 μm and a length of about 2 μm.

The first branch current $I_1$ will also vary in response to variations in the $V_{DD}$ supply voltage and the negative supply voltage $V_{NEG}$. As the $V_{DD}$ supply voltage increases and/or the negative supply voltage $V_{NEG}$ decreases, the first branch current $I_1$ will increase. Similarly as the $V_{DD}$ supply voltage decreases and/or the negative supply voltage $V_{NEG}$ increases, the first branch current $I_1$ will decrease.

The first branch current $I_1$ will also vary in response to variations the threshold voltages of PMOS transistor P1 and NMOS transistors N1-N2. As the PMOS transistor threshold voltage ($V_{TP}$) and the NMOS transistor threshold voltage ($V_{TN}$) increase/decrease (typically due to process variation), the first branch current $I_1$ will decrease/increase.

PMOS transistors P2-P3 and NMOS transistor N3 form a second current branch 112 between the $V_{DD}$ voltage supply rail 101 and the negative voltage supply rail 104. The sources of PMOS transistors P2 and P3 are coupled to the $V_{DD}$ voltage supply rail 101, and the drains of PMOS transistors P2 and P3 are coupled to second branch node X. The gate of PMOS transistor P2 is coupled to the ground supply voltage (0 Volts). Note that biasing the gate of PMOS transistor P2 with the ground supply voltage causes this transistor P2 to operate in a saturation region, because the ground supply voltage is lower than the $V_{DD}$ supply voltage by an amount slightly greater than the sum of the magnitude of the threshold voltage of PMOS transistor P2 (i.e., $|V_{TP}|$ or about 0.8 V) and the source-to-drain voltage of PMOS transistor P2 when this transistor P2 operates in a saturation region (i.e., ΔVsd_pmos_sat or about 0.1 V). That is, $V_{DD}-|V_{TP}|-\Delta Vsd_pmos_sat>0$ Volts. The gate of PMOS transistor P3 is coupled to node X, such that PMOS transistor P3 operates as a diode. In this manner, PMOS transistors P2 and P3 are connected in parallel between the $V_{DD}$ voltage supply rail and the second branch node X. Thus, PMOS transistor P2 may be referred to as a first sub-branch of the second current branch 112, and PMOS transistor P3 may be referred to as a second sub-branch of the second current branch 112. The currents flowing through PMOS transistors P2 and P3 are labeled as the second branch sub-currents $I_{2A}$ and $I_{2B}$, respectively.

NMOS transistor N3 has a drain coupled to second branch node X, and a source coupled to the negative voltage supply rail 104. The gate of NMOS transistor N3 is coupled to the gate (and drain) of NMOS transistor N2. The device sizes are selected to ensure that NMOS transistor N3 and PMOS transistors P2 and P3 each operate in a saturation region. Thus, NMOS transistors N2 and N3 are connected in a current mirror configuration, wherein the current flowing through NMOS transistor N2 (i.e., the first branch current $I_1$) is mirrored to NMOS transistor N3, as the second (mirrored) branch current $I_2$. In the described embodiment, NMOS transistors N2 and N3 have the same size. Ignoring any differences in the drain-to-source voltages of NMOS transistors N2 and N3, the second branch current $I_2$ is equal to the first branch current $I_1$. Thus, the second branch current $I_2$ varies in the same manner as the first branch current $I_1$ in response to variations in temperature, supply voltages $V_{DD}$ & $V_{NEG}$, and transistor threshold voltages. In other embodiments, the NMOS transistors N2 and N3 may have different sizes, such that the ratio of the second branch current $I_2$ to the first branch current $I_1$ will depend on the ratio of the size of the NMOS transistor N3 to the size of the NMOS transistor N2. In a particular embodiment, PMOS transistor P2 has a width of about 2 μm and a length of about 2 μm, PMOS transistor P3 has a width of about 3 μm and a length of about 2 μm, and NMOS transistor N3 has a width of about 2 μm and a length of about 2 μm (such that the second branch current $I_2$ is about equal to the first branch current $I_1$) In an alternate embodiment, NMOS transistor N3 can have a width of about 4 μm and a length of about 2 μm (such that the second branch current $I_2$ is about two times the first branch current $I_1$).

Note that the second branch current $I_2$ is supplied by the second branch sub-currents $I_{2A}$ and $I_{2B}$, which flow through PMOS transistors P2 and P3, respectively. That is, the second branch current $I_2$ is equal to the sum of the second branch sub-currents $I_{2A}$ and $I_{2B}$ (i.e., $I_2=I_{2A}+I_{2B}$).

In the present embodiment, the branch sub-current $I_{2B}$ through PMOS transistor P3 is used to generate a reference current. More specifically, PMOS transistor P4 is connected in a current mirror configuration with PMOS transistor P3 (i.e., the gates of PMOS transistors P3 and P4 are commonly connected to the drain of PMOS transistor P3, and the sources of PMOS transistors P3 and P4 are commonly connected to the $V_{DD}$ voltage supply rail 101), thereby forming an output stage of reference current generation circuit 100. Under these conditions, the branch sub-current $I_{2B}$ is mirrored to PMOS transistor P4 to create the reference current $I_{REF}$. In the described embodiments, transistors P3 and P4 are designed such that reference current $I_{REF}$ is equal to the branch sub-current $I_{2B}$, although this is not necessary. In a particular embodiment, both PMOS transistor P3 and P4 have a width of about 3 μm and a length of about 2 μm. The reference current $I_{REF}$ has many applications known to those of ordinary skill in the art, including, but not limited to, a reference current which is compared with a read current during a read operation of a memory cell.

As described in more detail below, the branch sub-current $I_{2B}$ (and therefore the associated reference current $I_{REF}$) is advantageously more resistant to variations in the supply voltage $V_{DD}$ and variations in the PMOS transistor threshold voltage ($V_{TP}$) than the first branch current $I_1$. That is, the rate of change of the branch sub-current $I_{2B}$ is less than the rate of change of the first branch current $I_1$ in response to variations in $V_{DD}$ and/or $V_{TP}$.

The branch sub-current $I_{2A}$ through PMOS transistor P2 is proportional to the difference between the source-to-gate voltage of transistor P2 ($Vsg_{P2}$) and the threshold voltage of PMOS transistor P2 ($V_{TP2}$). That is, $I_2 \alpha (Vsg_{P2}-|VT_{P2}|)$. Because the gate of PMOS transistor P2 is grounded, the source-to-gate voltage of PMOS transistor P2 is equal to the $V_{DD}$ supply voltage (i.e., $Vsg_{P2}=V_{DD}$). Thus, the branch sub-current $I_{2A}$ through PMOS transistor P2 is proportional to ($V_{DD}-|V_{TP2}|$).

If the $V_{DD}$ supply voltage decreases, and/or the PMOS transistor threshold voltage ($V_{TP}$) increases, the first branch current $I_1$ (and therefore the mirrored second branch current $I_2$) will decrease due to a reduced voltage at the drain of PMOS transistor P1. However, under these conditions, the branch sub-current $I_{2A}$ through PMOS transistor P2 will also decrease, because the value of ($V_{DD}-|V_{TP2}|$) becomes smaller.

Conversely, if the $V_{DD}$ supply voltage increases, and/or the PMOS transistor threshold voltage ($V_{TP}$) decreases, the first branch current $I_1$ (and therefore the mirrored second branch current $I_2$) will increase due to an increased voltage at the drain of PMOS transistor P1. However, under these conditions, the branch sub-current $I_{2A}$ through PMOS transistor P2 will also increase, because the value of ($V_{DD}-|V_{TP2}|$) becomes larger.

As described above, the branch sub-current $I_{2B}$ through PMOS transistor P3 is equal to the difference between the second branch current $I_2$ and the branch sub-current $I_{2A}$ through PMOS transistor P2 (i.e., $I_{2B}=I_2-I_{2A}$). Because the second branch current $I_2$ and the branch sub-current $I_{2A}$ through PMOS transistor P2 vary in the same manner (i.e., the same direction) in response to variations in the $V_{DD}$ supply voltage and variations in the PMOS transistor threshold voltage $V_{TP}$, the variation in the branch sub-current $I_{2B}$ due to variations in the $V_{DD}$ supply voltage and/or the PMOS transistor threshold voltage $V_{TP}$ is smaller than the variation in the first branch current $I_1$. This reduction in current variation can be quantified by comparing the maximum-to-minimum ratio of the first branch current $I_1$ to the maximum-to-minimum ratio of the branch sub-current $I_{2B}$.

FIG. 2 is a table 200 that defines the voltage and process conditions that result in minimum, maximum and typical currents within reference current generation circuit 100. For example, minimum currents ($I_{MIN}$) will exist when the $V_{DD}$ supply voltage is at the low end of its range, the negative supply voltage $V_{NEG}$ is at the high end of its range, the transistors P1-P3 and N1-N2 have relatively high threshold voltages as a result of a slow process corner, and the resistor R1 has a relatively high resistance as a result of a slow process corner. Conversely, maximum currents ($I_{MAX}$) will exist when the $V_{DD}$ supply voltage is at the high end of its range, the negative supply voltage $V_{NEG}$ is at the low end of its range, the transistors P1-P3 and N1-N2 have relatively low threshold voltages as a result of a fast process corner, and the resistor R1 has a relatively low resistance as a result of a fast process corner. 'Typical' currents ($I_{TYP}$) exist at the nominal $V_{DD}$ and $V_{NEG}$ voltages, intermediate transistor threshold voltages, and an intermediate temperature exists.

Table 200 assigns exemplary values to the first and second branch currents $I_1/I_2$, the branch sub-current $I_{2A}$ and the branch sub-current/reference current $I_{2B}/I_{REF}$ for the minimum, maximum and typical current conditions. These exemplary current values were generated by a simulation program, and are referenced to the minimum value of the first branch current $I_1$, which is assigned a nominal value of 100.

According to table 200, the maximum value of the first branch current $I_1$ is about 2.65 times the minimum value of the first branch current $I_1$ (i.e., $I_{1MAX}/I_{1MIN}=2.65$), which represents a 165% variation in the first branch current $I_1$ across worst case conditions. However, the maximum value of the reference current $I_{REF}$ is about 1.86 times the minimum value of the reference current $I_{REF}$ (i.e., $I_{REFMAX}/I_{REFMIN}=1.86$), which represents an 86% variation in the reference current $I_{REF}$ across worst case conditions. Thus, the variation of the reference current $I_{REF}$ is advantageously less than the variation of the first branch current $I_1$.

Note that as the voltage, process and temperature conditions vary to increase the currents, the branch sub-current $I_{2A}$ increases at a rate faster than the first branch current $I_1$, such that the branch sub-current $I_{2B}$ (and therefore the reference current $I_{REF}$) increases at a rate slower than the first branch current $I_1$. This ensures that the variation in the branch sub-current $I_{2B}$ (and therefore the variation in the reference current $I_{REF}$) is less than the variation in the first branch current $I_1$. For example, from the minimum current conditions ($I_{MIN}$) to the maximum current conditions ($I_{MAX}$), the branch sub-current $I_{2A}$ increases by 244% (i.e., (172−50)/50), while the first branch current $I_1$ increases by 165%, and the reference current $I_{REF}$ increases by 86%. Similarly, from the minimum current condition ($I_{MIN}$) to the typical current conditions ($I_{TYP}$), the branch sub-current $I_{2A}$ increases by 120%, the first branch current $I_1$ increases by 80% and the reference current $I_{REF}$ only increases by 40%. From the typical current conditions ($I_{TYP}$) to the maximum current conditions ($I_{MAX}$) the branch sub-current $I_{2A}$ increases by 56%, the first branch current $I_1$ increases by 47% and the reference current $I_{REF}$ only increases by 32%.

Figure 3:
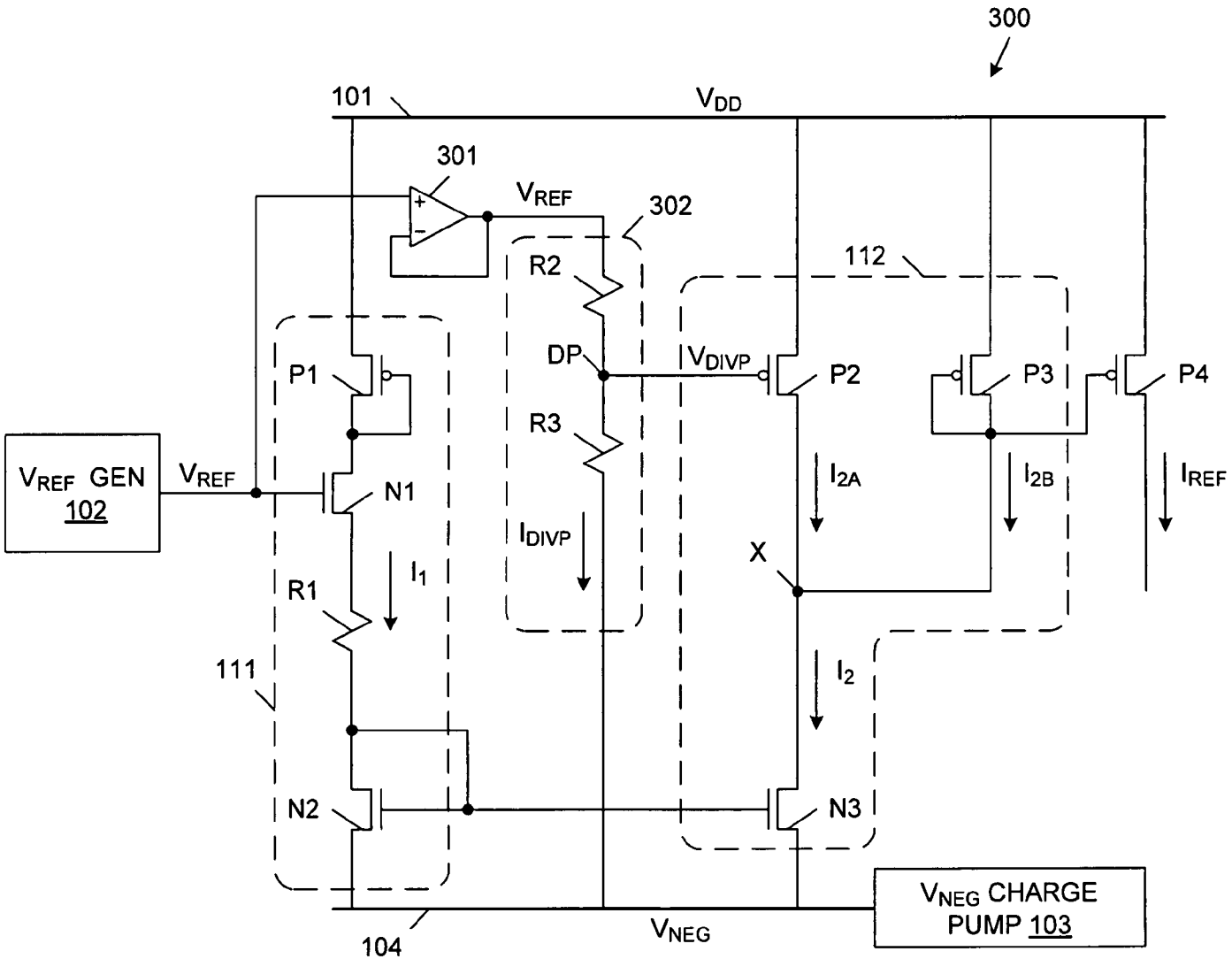
FIG. 3 is a circuit diagram of a reference current generation circuit in accordance with an alternate embodiment of the present invention.

FIG. 3 is a circuit diagram of a reference current generation circuit 300 in accordance with an alternate embodiment of the present invention. As described in more detail below, reference current generation circuit 300 reduces variations in the reference current $I_{REF}$ in the presence of variations (i.e., ripples) in the negative supply voltage $V_{NEG}$. Because reference current generation circuit 300 is similar to reference current generation circuit 100, similar elements in FIGS. 1 and 3 are labeled with similar reference numbers. In addition to the above-described elements of reference current generation circuit 100, reference current generation circuit 300 includes operational amplifier 301 and a voltage divider circuit 302, which includes resistors R2-R3. In general, operational amplifier 301 and voltage divider circuit 302 operate to apply a voltage ($V_{DIVP}$) that varies in response to variations in the negative supply voltage $V_{NEG}$ to the gate of PMOS transistor P2 (rather than simply applying the ground supply voltage to the gate of PMOS transistor P2, as taught by the reference current generation circuit 100 of FIG. 1).

Operational amplifier 301 has a positive input terminal coupled to receive the reference voltage $V_{REF}$, and a negative input terminal coupled to an output terminal. As a result, operational amplifier 301 provides the reference voltage $V_{REF}$ on its output terminal, and drives a substantial current $I_{DIVP}$ through series-connected resistors R2 and R3. (Note that reference voltage generation circuit 102 typically does not have a significant current driving capability.)

Resistor R2 is connected between the output of operational amplifier 301 and voltage divider node DP. Resistor R3 is connected between voltage divider node DP and the negative voltage supply terminal 104. Voltage divider node DP is also coupled to the gate of PMOS transistor P2. Resistors R2 and R3 form a voltage divider circuit, which develops a control voltage $V_{DIVP}$ on voltage divider node DP. This control voltage $V_{DIVP}$ is equal to: $V_{REF}-(V_{REF}-V_{NEG})*r2/(r2+r3)$, wherein r2 and r3 represent the resistances of resistors R2 and R3, respectively.

In accordance with one embodiment, the ratio of the resistances r2/r3 is selected such that the voltage $V_{DIVP}$ is slightly less than $V_{DD}-|V_{TP}|-\Delta Vsd_pmos_sat$, wherein $|V_{TP}|$ is the magnitude of the threshold voltage of PMOS transistor P2 (or about 0.8 Volts), and ΔVsd_pmos_sat is the source-to-drain voltage of PMOS transistor P2 in saturation mode (or about 0.1 Volts). In the described embodiment, $V_{DIVP}$ is designed to have a voltage of about 0 Volts, wherein the resistance r2 is about one half of the resistance r3. In a particular embodiment, the resistance r2 is about 120 kΩ and the resistance r3 is about 250 kΩ. In the described example, the nominal control voltage $V_{DIVP}$ on node DP is about 0.02 Volts (i.e., 1.23−(1.23−(−2.5))*120/370). However, as the negative supply voltage $V_{NEG}$ varies between the specified low voltage of −2.75 Volts and the specified high voltage of −2.25 Volts, the control voltage $V_{DIVP}$ on the voltage divider node DP will also vary. Note that variations in the negative supply voltage $V_{NEG}$ may exist as an ongoing voltage ripple, as a result of the repeated charging and discharging of capacitors within the negative voltage charge pump 103.

When the negative supply voltage $V_{NEG}$ increases (towards the specified high voltage of −2.25 Volts), the control voltage $V_{DIVP}$ will also increase. The increased control voltage $V_{DIVP}$ reduces the source-to-gate voltage $Vsg_{P2}$ of PMOS transistor P2, thereby reducing the branch sub-current $I_{2A}$ through PMOS transistor P2.

Conversely, when the negative supply voltage $V_{NEG}$ decreases (toward the specified low voltage of −2.75 Volts), the control voltage $V_{DIVP}$ will also decrease. The reduced control voltage $V_{DIVP}$ increases the source-to-gate voltage $Vsg_{P2}$ of PMOS transistor P2, thereby increasing the branch sub-current $I_{2A}$ through PMOS transistor P2.

As described above in connection with FIG. 1, if the negative supply voltage $V_{NEG}$ increases, the first branch current $I_1$, and therefore the second branch current $I_2$, will decrease. However, as the negative supply voltage $V_{NEG}$ increases, the control voltage $V_{DIVP}$ also increases, thereby reducing the branch sub-current $I_{2A}$ through PMOS transistor P2. The reduction in the branch sub-current $I_{2A}$ offsets the reduction in the second branch current $I_2$, thereby significantly reducing the rate of decrease in the branch sub-current $I_{2B}$, and therefore the rate of decrease in the reference current $I_{REF}$.

Conversely, if the negative supply voltage $V_{NEG}$ decreases, the first branch current $I_1$, and therefore the second branch current $I_2$, will increase. However, as the negative supply voltage $V_{NEG}$ decreases, the control voltage $V_{DIVP}$ also decreases, thereby increasing the branch sub-current $I_{2A}$ through PMOS transistor P2. The increase in the branch sub-current $I_{2A}$ offsets the increase in the second branch current $I_2$, thereby significantly reducing the rate of increase in the branch sub-current $I_{2B}$, and therefore, the rate of increase in the reference current $I_{REF}$.

In this manner, the voltage divider circuit 302 advantageously causes the reference current $I_{REF}$ to be more stable (i.e., have less variation) in the presence of variations in the negative supply voltage $V_{NEG}$.

In one simulation of the above-described reference current generation circuit 300, which uses the maximum and minimum current conditions specified by table 200, the maximum value of the reference current $I_{REF}$ is about 1.45 times the minimum value of the reference current $I_{REF}$ (i.e., $I_{REFMAX}/I_{REFMIN}=1.45$), which represents a 45% variation. Thus, the variation of the reference current $I_{REF}$ of the reference current generation circuit 300 is advantageously less than the variation of the reference current $I_{REF}$ of the reference current generation circuit 100 (i.e., 86%).

Figure 4:
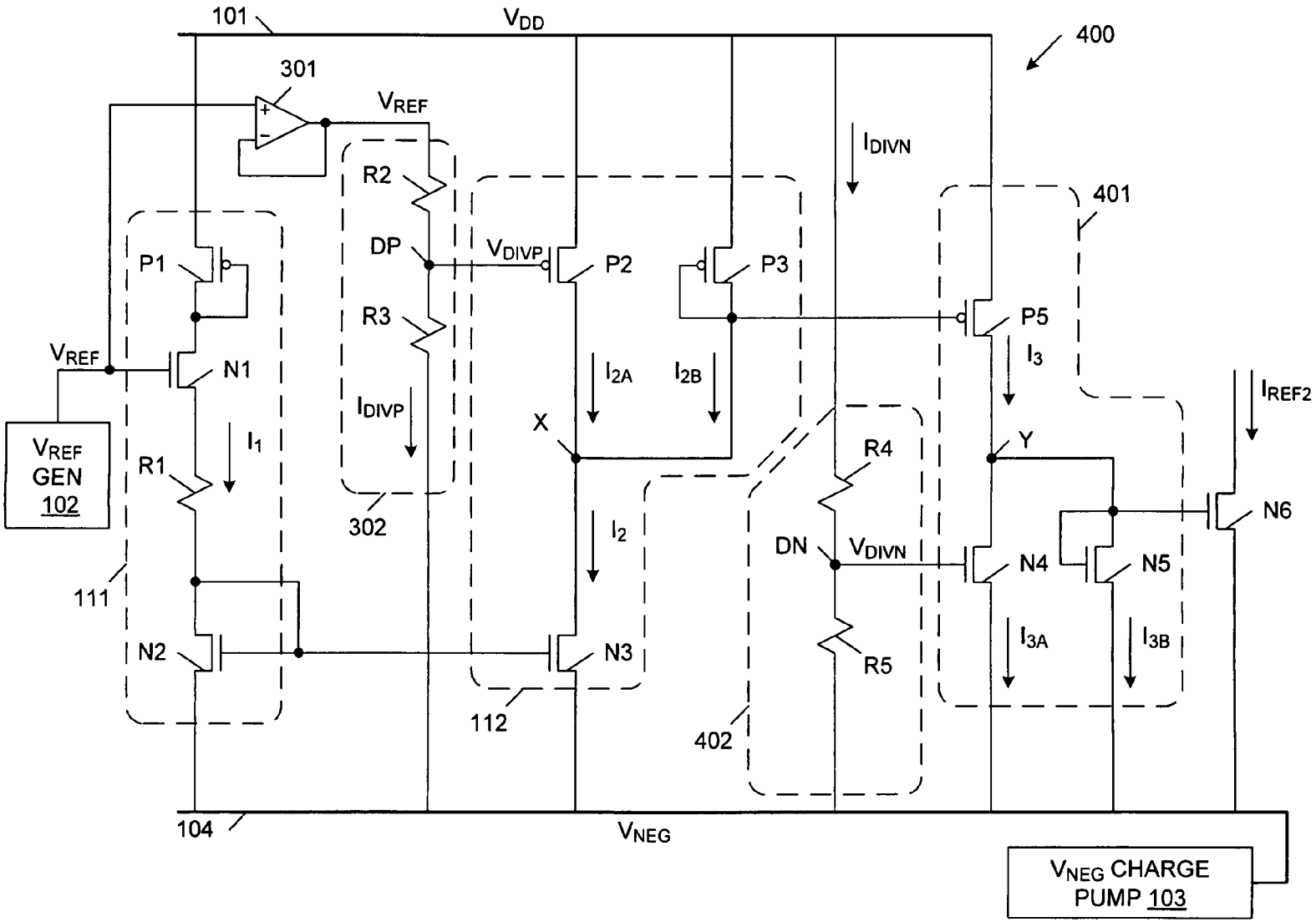
FIG. 4 is a circuit diagram of a reference current generation circuit in accordance with yet another embodiment of the present invention.

FIG. 4 is a circuit of a reference current generation circuit 400 in accordance with another embodiment of the present invention. As described in more detail below, reference current generation circuit 400 further reduces variations in the generated reference current $I_{REF2}$ in the presence of variations in NMOS transistor threshold voltages ($V_{TN}$). Because reference current generation circuit 400 is similar to reference current generation circuit 300, similar elements in FIGS. 3 and 4 are labeled with similar reference numbers. In addition to the above-described elements of reference current generation circuit 300, reference current generation circuit 400 includes a third current branch 401 between the $V_{DD}$ voltage supply rail 101 and the negative voltage supply rail 104, and a voltage divider circuit 402. The PMOS transistor P4, which provides the reference currents $I_{REF}$ in reference current generation circuits 100 and 300, is not included in reference current generation circuit 400. Instead, reference current generation circuit 400 includes an NMOS transistor N6, which provides the reference current $I_{REF2}$.

The third current branch 401 of circuit 400 includes NMOS transistors N4-N5 and PMOS transistor P5. The sources of NMOS transistors N4 and N5 are coupled to the negative voltage supply rail 104, and the drains of NMOS transistors N4 and N5 are coupled to third branch node Y. The gate of NMOS transistor N4 is coupled to receive a control voltage $V_{DIVN}$ from voltage divider circuit 402. The gate of NMOS transistor N5 is coupled to node Y, such that NMOS transistor N5 operates as a diode. In this manner, NMOS transistors N4 and N5 are connected in parallel between the negative voltage supply rail 104 and the third branch node Y. Thus, NMOS transistor N4 may be referred to as a first sub-branch of the third current branch 401, and NMOS transistor N5 may be referred to as a second sub-branch of the third current branch 401. The currents flowing through NMOS transistors N4 and N5 are labeled as the third branch sub-currents $I_{3A}$ and $I_{3B}$, respectively.

PMOS transistor P5 has a drain coupled to third branch node Y, and a source coupled to the $V_{DD}$ voltage supply rail 101. The gate of PMOS transistor P5 is coupled to the gate (and drain) of PMOS transistor P3. The device sizes are selected to ensure that PMOS transistor P5 and NMOS transistors N4-N5 each operate in the saturation region. In a particular embodiment, PMOS transistor P5 has a width of about 3 μm and a length of about 2 μm, NMOS transistor N4 has a width of about 2 μm and a length of about 2 μm, and NMOS transistors N5 and N6 each have a width of about 2 μm and a length of about 3 μm. PMOS transistors P3 and P5 are connected in a current mirror configuration, wherein the current flowing through PMOS transistor P3 (i.e., the branch sub-current $I_{2B}$) is mirrored to PMOS transistor P5, as the third (mirrored) branch current $I_3$. PMOS transistors P3 and P5 may be sized in the same manner as NMOS transistors N2 and N3 (described above). In the described embodiment, PMOS transistors P3 and P5 are sized such that the third branch current $I_3$ is equal to the branch sub-current $I_{2B}$. The third branch current $I_3$ therefore varies in the same manner as the branch sub-current $I_{2B}$. Note that the third branch current $I_3$ supplies the third branch sub-currents $I_{3A}$ and $I_{3B}$, which flow through NMOS transistors N4 and N5, respectively. The third branch current $I_3$ therefore is equal to the sum of the branch sub-currents $I_{3A}$ and $I_{3B}$ (i.e., $I_3=I_{3A}+I_{3B}$).

In the present embodiment, the branch sub-current $I_{3B}$ through NMOS transistor N5 is used to generate the reference current $I_{REF2}$. More specifically, NMOS transistors N5 and N6 are connected in a current mirror configuration, such that the branch sub-current $I_{3B}$ is mirrored to NMOS transistor N6 to create the reference current $I_{REF2}$. In the described embodiments, NMOS transistors N5 and N6 are designed such that reference current $I_{REF2}$ is equal to the branch sub-current $I_{3B}$, although this is not necessary.

Voltage divider circuit 402 includes resistors R4 and R5, which are connected in series between the $V_{DD}$ voltage supply rail 101 and the negative voltage supply rail 104 as illustrated. Resistors R4 and R5 share a common voltage divider node DN, which is coupled to the gate of NMOS transistor N4. Voltage divider circuit 402 develops a control voltage $V_{DIVN}$ on voltage divider node DN. This control voltage $V_{DIVN}$ is equal to: $V_{DD}-(V_{DD}-V_{NEG})*r4/(r4+r5)$, wherein r4 and r5 represent the resistances of resistors R4 and R5, respectively.

In accordance with one embodiment, the ratio of the resistances r4/r5 is selected such that the voltage $V_{DIVN}$ is approximately equal to $V_{TN}+\Delta Vds_nmos_sat+V_{NEG}$, wherein $V_{TN}$ is the threshold voltage of NMOS transistor N4 (or about 0.8 Volts), and ΔVds_nmos_sat is the drain-to-source voltage of NMOS transistor N4 when this transistor operates in saturation region (or about 0.1 Volt). In the described embodiment, the $V_{DIVN}$ should therefore be approximately equal to −1.6 Volts (0.8 Volts+0.1 Volts −2.5 Volts), wherein the resistance r4 is about three times the resistance r5. In a particular example, the resistance r4 is about 280 kΩ and the resistance r5 is about 90 kΩ. In this example, the nominal control voltage $V_{DIVN}$ on node DN is about −1.6 Volts (i.e., 1.2−(1.2−(−2.5))*280/370). Note that the gate-to-source voltage $Vgs_{N4}$ of NMOS transistor N4 (e.g., −1.6 V−(−2.5 V)) is sufficiently high to turn on NMOS transistor N4.

As the $V_{DD}$ supply voltage varies between the specified low of 1.08 Volts and the specified high of 1.32 Volts, and the negative supply voltage $V_{NEG}$ varies between the specified low voltage of −2.75 Volts and the specified high voltage of −2.25 Volts, the control voltage $V_{DIVN}$ on the voltage divider node DN will also vary.

For example, as the $V_{DD}$ supply voltage increases, the control voltage $V_{DIVN}$ will also increase. The increased control voltage $V_{DIVN}$ increases the gate-to-source voltage ($Vgs_{N4}$) of NMOS transistor N4, thereby increasing the branch sub-current $I_{3A}$ through NMOS transistor N4.

Conversely, when the $V_{DD}$ supply voltage decreases, the control voltage $V_{DIVN}$ will also decrease. The reduced control voltage $V_{DIVN}$ decreases the gate-to-source voltage $Vgs_{N4}$ of NMOS transistor N4, thereby decreasing the branch sub-current $I_{3A}$ through NMOS transistor N4.

Also note that as the NMOS transistor threshold voltage $V_{TN}$ increases, the branch sub-current $I_{3A}$ through NMOS transistor N4 will decrease. Conversely, as the NMOS transistor threshold voltage $V_{TN}$ decreases, the branch sub-current $I_{3A}$ through NMOS transistor N4 will increase.

As described above in connection with FIG. 1, if the $V_{DD}$ supply voltage decreases and/or the NMOS transistor threshold voltage $V_{TN}$ increases, the first branch current $I_1$, and therefore the second branch current $I_2$, will decrease. This will also cause the third branch current $I_3$ to decrease. However, as the $V_{DD}$ supply voltage decreases, the control voltage $V_{DIVN}$ also increases, thereby reducing the branch sub-current $I_{3A}$ through NMOS transistor N4. Moreover, as the NMOS transistor threshold voltage $V_{TN}$ increases, the branch sub-current $I_{3A}$ through NMOS transistor N4 is reduced. The reductions in the branch sub-current $I_{3A}$ offset the reductions in the third branch current $I_3$, thereby significantly reducing the rate of decrease in the branch sub-current $I_{3B}$, and therefore the rate of decrease in the reference current $I_{REF2}$.

Conversely, if the $V_{DD}$ supply voltage increases and/or the NMOS transistor threshold voltage $V_{TN}$ decreases, the first branch current $I_1$, will increase, thereby causing the second and third branch currents $I_2$ and $I_3$ to increase. However, as the $V_{DD}$ supply voltage increases, the control voltage $V_{DIVN}$ also increases, thereby increasing the branch sub-current $I_{3A}$ through NMOS transistor N4. Moreover, as the NMOS transistor threshold voltage $V_{TN}$ decreases, the branch sub-current $I_{3A}$ through NMOS transistor N4 increases. The increases in the branch sub-current $I_{3A}$ offset the increases in the third branch current $I_3$, thereby significantly reducing the rate of increase in the branch sub-current $I_{3B}$, and therefore, the rate of increase in the reference current $I_{REF2}$.

In this manner, the voltage divider circuit 402 advantageously causes the reference current $I_{REF2}$ to be more stable (i.e., have less variation) in the presence of variations in the $V_{DD}$ supply voltage. Similarly, NMOS transistor N4 advantageously causes the reference current $I_{REF2}$ to be more stable in response to variations in the NMOS transistor threshold voltage $V_{TN}$.

In one simulation of the above-described reference current generation circuit 400, which uses the maximum and minimum current conditions specified by table 200 (FIG. 2), the maximum value of the reference current $I_{REF2}$ is about 1.25 times the minimum value of the reference current $I_{REF2}$ (i.e., $I_{REF2MAX}/I_{REF2MIN}$=1.25), which represents a 25% variation. Thus, the variation of the reference current $I_{REF2}$ of the reference current generation circuit 400 is advantageously less than the variation of the reference currents $I_{REF}$ of the reference current generation circuits 100 (i.e., 86%) and 300 (45%).

Although the present invention has been described in connection with several embodiments, it is understood that this invention is not limited to the embodiments disclosed, but is capable of various modifications and embodiments which would be apparent to one of ordinary skill in the art. It is, therefore, contemplated that the appended claims will cover any such modifications or embodiments as falling within the true scope of the invention.

We claim:

1. A method of generating a reference current comprising:

generating a first branch current that varies by a first percentage in response to variations in a first supply voltage and variations in a first threshold voltage of transistors having a first conductivity type;

mirroring the first branch current to create a corresponding second branch current;

supplying a first portion of the second branch current through a first transistor, wherein the first portion of the second branch current varies by a second percentage in response to the variations in the first supply voltage and the variations in the first threshold voltage, wherein the second percentage is greater than the first percentage;

supplying a second portion of the second branch current through a second transistor; and mirroring the second portion of the second branch current to create the reference current.

2. The method of claim 1, further comprising biasing the first transistor by applying the first supply voltage to a source of the first transistor.

3. The method of claim 2, further comprising biasing the first transistor by applying a ground supply voltage to a gate of the first transistor.

4. The method of claim 1, wherein the second branch current flows through a third transistor, wherein the first transistor and the third transistor each operate in a saturation region.

5. The method of claim 1, wherein the first transistor has the first conductivity type.

6. A method of generating a reference current comprising:

generating a first branch current that varies by a first percentage in response to variations in a first supply voltage, variations in a second supply voltage, and variations in a first threshold voltage of transistors having a first conductivity type;

mirroring the first branch current to create a corresponding second branch current;

supplying a first portion of the second branch current through a first transistor, wherein the first portion of the second branch current varies by a second percentage in response to the variations in the first supply voltage, the variations in the second supply voltage and the variations in the first threshold voltage, wherein the second percentage is greater than the first percentage;

supplying a second portion of the second branch current through a second transistor; and mirroring the second portion of the second branch current to create the reference current.

7. The method of claim 6, further comprising biasing the first transistor by applying the first supply voltage to a source of the first transistor, and a first control voltage to a gate of the first transistor, wherein the first control voltage varies in response to variations in a second supply voltage.

8. The method of claim 7, wherein the first supply voltage s a positive voltage and the second supply voltage is a negative voltage.

9. The method of claim 7, further comprising generating the second supply voltage with a charge pump.

10. A method of generating a reference current comprising:

generating a first branch current that varies by a first percentage in response to variations in a first supply voltage, variations in a second supply voltage, variations in a first threshold voltage of transistors having a first conductivity type, and variations in a second threshold voltage of transistors having a second conductivity type;

mirroring the first branch current to create a corresponding second branch current;

supplying a first portion of the second branch current through a first transistor, wherein the first portion of the second branch current varies by a second percentage in response to the variations in the first supply voltage, the variations in the second supply voltage and the variations in the first threshold voltage, wherein the second percentage is greater than the first percentage;

supplying a second portion of the second branch current through a second transistor; and mirroring the second portion of the second branch current to create a corresponding third branch current;

sinking a first portion of the third branch current through a fourth transistor, wherein the first portion of the third branch current varies by a third percentage in response to the variations in the first supply voltage and the variations in the second threshold voltage, wherein the third percentage is greater than the first percentage;

sinking a second portion of the third branch current through a fifth transistor; and mirroring the second portion of the third branch current to create the reference current.

11. A reference current generation circuit comprising:

a first voltage supply terminal that supplies a first supply voltage;

a second voltage supply terminal that supplies a second supply voltage;

a first current branch including a first transistor having a channel region with a first conductivity type, a second transistor having a channel region with a second conductivity type, opposite the first conductivity type, a resistor and a third transistor coupled in series between the first and second voltage supply terminals, whereby a first branch current flows through the first transistor, the second transistor, the resistor and the third transistor;

a second current branch including a fourth transistor coupled between the second voltage supply terminal and a second branch node, a fifth transistor having a channel region with the first conductivity type coupled between the first voltage supply terminal and the second branch node, and a sixth transistor coupled in parallel with the fifth transistor between the first voltage supply terminal and the second branch node, wherein the fourth transistor is connected in a current mirror configuration with the third transistor, whereby the first branch current is mirrored to the fourth transistor as a second branch current; and a seventh transistor connected in a current mirror configuration with the sixth transistor, whereby a current through the sixth transistor is mirrored to the seventh transistor.

12. The reference current generation circuit of claim 11, wherein the seventh transistor provides a reference current of the reference current generation circuit.

13. The reference current generation circuit of claim 11, wherein the fourth transistor is a PMOS transistor having a gate coupled to ground.

14. The reference current generation circuit of claim 11, further comprising a charge pump circuit coupled to the second voltage supply terminal, wherein the charge pump circuit supplies the second supply voltage by alternately charging and discharging one or more capacitors.

15. The reference current generation circuit of claim 14, wherein first supply voltage is a positive voltage and the second supply voltage is a negative voltage.

16. The reference current generation circuit of claim 11, wherein the first transistor and the sixth transistor are configured to operate as diodes.

17. The reference current generation circuit of claim 11, further comprising a voltage divider circuit coupled to apply a control voltage to a gate of the fourth transistor, wherein the voltage divider circuit is also coupled to the second voltage supply terminal, whereby the control voltage varies in response to variations in the second supply voltage.

18. The reference current generation circuit of claim 11, further comprising a reference voltage generator that applies a reference voltage to a gate of the second transistor.

19. The reference current generation circuit of claim 11, further comprising a third current branch including the seventh transistor, which is coupled between the first voltage supply terminal and a third branch node, an eighth transistor having a channel region of a second conductivity type coupled between the second voltage supply terminal and the third branch node, and a ninth transistor coupled in parallel with the eighth transistor between the second voltage supply terminal and the third branch node.

20. The reference current generation circuit of claim 19, further comprising a tenth transistor connected in a current mirror configuration with the ninth transistor, whereby a current through the ninth transistor is mirrored to the tenth transistor.

21. The reference current generation circuit of claim 19, further comprising a voltage divider circuit coupled to apply a control voltage to a gate of the eighth transistor, wherein the voltage divider circuit is also coupled to the first voltage supply terminal, whereby the control voltage varies in response to variations in the first supply voltage.

* * * * *